United States Patent [19]

Bodine

[11] Patent Number: 4,645,017

[45] Date of Patent: Feb. 24, 1987

[54] VIBRATIONAL ISOLATION SYSTEM FOR SONIC PILE DRIVER

[76] Inventor: Albert G. Bodine, 7877 Woodley Ave., Van Nuys, Calif. 91406

[21] Appl. No.: 721,688

[22] Filed: Apr. 10, 1985

[51] Int. Cl.[4] ..... E21B 7/24

[52] U.S. Cl. ..... 173/162 R; 175/56; 405/232

[58] Field of Search ..... 173/128, 162 R; 175/55, 175/56, 171; 405/232, 228, 175

[56] References Cited

U.S. PATENT DOCUMENTS

| | | | |
|---|---|---|---|
| 383,004,389 | 10/1961 | Müller | 175/56 |
| 3,155,163 | 11/1964 | Bodine, Jr. | 175/56 |
| 3,379,263 | 4/1968 | Bodine, Jr. | 175/55 |
| 3,391,748 | 7/1968 | Bodine | 175/56 |

FOREIGN PATENT DOCUMENTS

| | | | |
|---|---|---|---|
| 1099953 | 2/1961 | Fed. Rep. of Germany | 175/56 |

*Primary Examiner*—Frank T. Yost

*Assistant Examiner*—Hien H. Phan

*Attorney, Agent, or Firm*—Edward A. Sokolski

[57] ABSTRACT

Vibrational isolation is provided from the sonic energy employed to drive a piling or the like into the ground for the suspension and support system for the equipment, and for the power drive source for driving the sonic oscillators employed. A separate isolation system is provided for the support structure and for the power drive, each of these separate systems being optimized for the particular situation at hand. Thus, in providing vibrational isolation for the suspension and support mechanism, heavy large springs may be employed, capable of handling high loads, and having a relatively low spring rate to attain the desired isolation. On the other hand, the isolation system for the power drive employs relatively soft springs which effectively isolate the power drive from the vibrational excursions of the oscillator so as to avoid undue stress on the power drive, which might result in misalignment thereof, and damage to components of the power drive.

9 Claims, 3 Drawing Figures

VIBRATIONAL ISOLATION SYSTEM FOR SONIC PILE DRIVER

This invention relates to sonic pile drivers and more particularly to such a pile driver having separate vibration isolation systems for the support and power drive components thereof.

In my U.S. Pat. No. 3,291,227, a sonic pile driver is described which employs sonic resonant operation in effecting the driving of a pile into an earthen formation. In this system, vibrational isolation is provided for the suspension and power drive systems employed to avoid the dissipation of sonic energy in these components, and to avoid undue stress on such components from the vibrational energy.

In the vibrational isolation system employed in the aforementioned patent, a single isolator mechanism is provided for both the power drive and support components. It has been found that the use of a single system for handling both the power drive and support components offers distinct disadvantages. This is due to the fact that the requirements for providing vibrational isolation for the power drive components are quite different from those for the support components. This incompatability is in view of the fact that the power drive components require a constant alignment for the mechanical drive elements to avoid damage to drive components such as universal joints and the like. On the other hand, the support components require rather heavy, durable vibrational isolation elements capable of handling a wide range of high loads with a permissibly wide range of elastic displacement and without any need for maintaining the type of alignment required for the power drive components. Thus, the support components generally require isolators having an extensive latitude of elastic deformation for widely ranging load capacity, while the power drive components generally require isolators for handling a very small elastic dislocation. This inconsistency cannot be reconciled with a single isolation system without making distinct compromises. The design of my aforementioned Patent No. 3,291,227 while providing proper isolation for the support and suspension components, is highly inadequate for the power drive components in that without very complicated centering means, it fails to avoid excessive misalignment of the power drive components such as the drive shaft, universal joints and the like, resulting in excessive stress on such components, and their eventual premature failure.

It is therefore an object of this invention to provide an improved vibrational isolation system for a sonic pile driver.

It is a further object of this invention to separately optimize the vibrational isolation of the support components and the power drive components employed in a sonic vibrational system.

Other objects of this invention will become apparent as the description proceeds in connection with the accompanying drawings of which:

Briefly described, my invention incorporates a first vibrational isolator mechanism which typically comprises a large, heavy capacity spring or springs capable of long stretching or compression which is placed between the support components for a pile driver and the sonic oscillator for sonicaly driving a pile; and a second vibration isolator dealing with minimal elastic distortion placed between the oscillator and the fixed mass power drive system for the oscillator. The first vibration isolation system generally can have a relatively low spring constant with long stroke, but must always have rather high load handling capacity and an elastic distortion capabilities for handling the wide range of loads of the piles (typically hundreds of thousands of pounds) as well as and the driving forces applied thereto, while the second vibration isolation system is arranged to operate in an environment with no significant load variation or substantial stretching forces and need only be capable of handling the vibrational stroke generated by the oscillator relative to the small fixed mass mechanical load of the permanently located power drive components. The natural frequency of the vibration isolation system for the power drive and the mass of the components directly connected thereto is made to be substantially different from that of the vibration frequency of the pile drive system so as to avoid any resonant vibration of this isolation system. The vibration isolators may comprise coil springs appropriately mounted and positioned so as to provide the required vibration isolation. For very heavy loads, such as in the case of offshore pilings, the first isolator may comprise a large compressed air spring such as element 30 in my U.S. Pat. No. 4,429,743.

Figure 1:
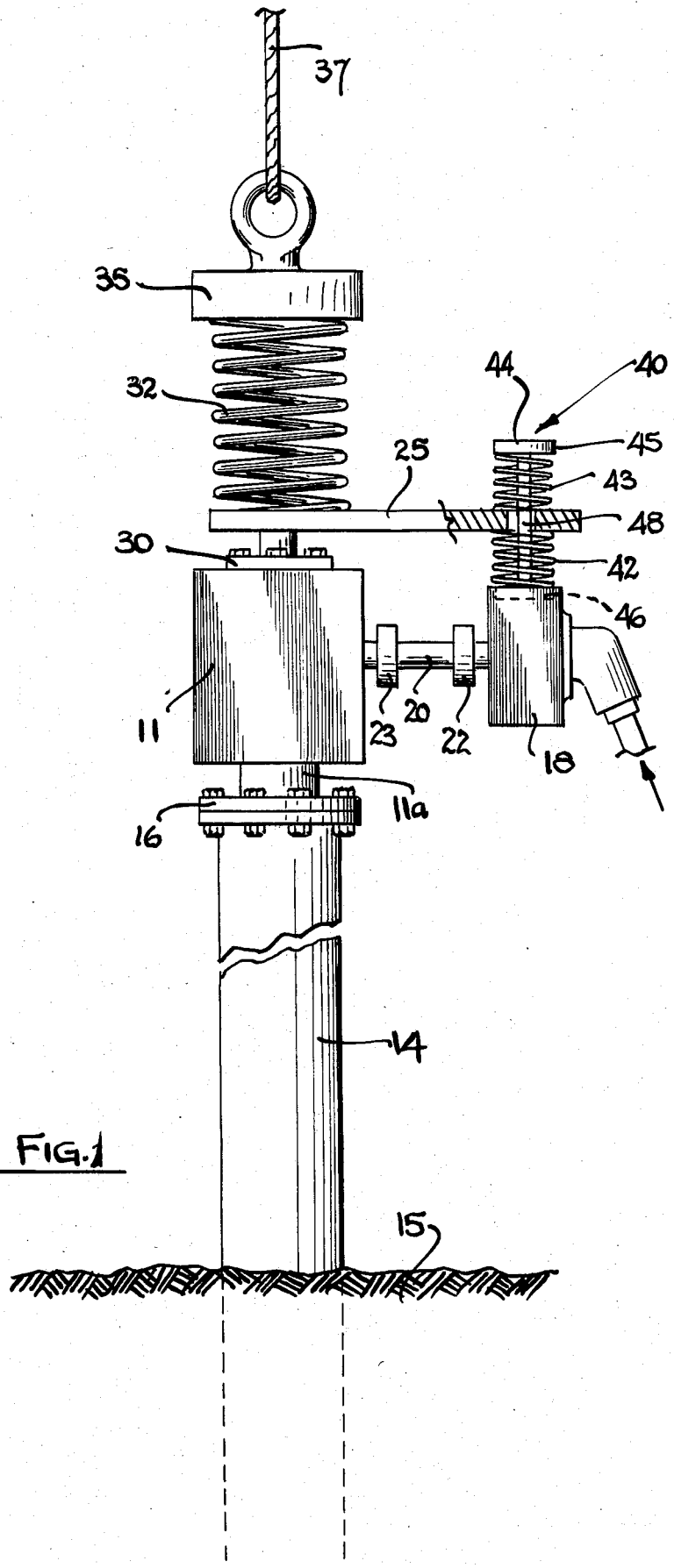
FIG. 1 is an elevational view of a first embodiment of the invention.

Referring now to FIG. 1, an embodiment of the invention is schematically illustrated. An orbiting mass oscillator 11 which generates sonic energy, and may be of the type described in my aforementioned U.S. Pat. No. 3,291,227, is coupled by means of a flange-bolt coupling assembly 16 to pile 14 which is being driven into earthen formation 15. The rotor of oscillator 11 is rotatably driven by means of hydraulic motor 18, through a drive train which includes drive shaft 20 and universal joints 22 and 23. Rigid bar member 25 is firmly connected to the housing of oscillator 11 by means of flange-bolt assembly 30. Fixedly attached to bar member 25 as by welding is the bottom end of coil spring 32. Coil spring 32 is a heavy capacity spring having a relatively long travel and wide load range. The top end of spring 32 is fixedly attached to carrier assembly 35 as by welding, this carrier assembly having a cable 37 for use in lifting and lowering the pile by means of a crane. Spring 32 must be sturdy enough to handle the wide range of loads of the piles and at the same time, must have sufficient compliance to provide vibrational isolation between the carrier 35 and oscillator 11. This is provided by having a wide range of elastic deformation. Carrier 35 is permitted to displace substantially relative to bar 25.

As described in my aforementioned U.S. Pat. No. 3,291,227, oscillator 11 is driven by means of hydraulic motor 18 so as to generate sonic elastic resonant vibration of pile 14, this frequency typically being of the order of 60–150 Hz. To vibrationally isolate hydraulic motor 18 and its associated components from the sonic enegy, this motor is supported pn bar member 25 by means of spring assembly 40. This spring assembly comprises a lower spring 42, which is interposed between bar 25 and motor assembly 18, and an upper spring 43 interposed between the head of spring retainer member 44, and the upper surface of bar 25. Retainer 44 is vertically slideably supported on the casing of motor assembly 18, and retained to this casing by a head portion 46 which is within the casing wall, the shaft 48 of the retainer member being fitted through an aperture formed in such wall. In this manner, the position of casing 18 may be set so as to maintain drive shaft 20 in a substantially permanently horizontal orientation. Average tension of springs 42 and 43 is capable of holding the fixed mass casing 18 in position. All of this is independent of the normally wide stretching and compressing of large spring 32.

Springs 42 and 43 are chosen so that their resonant frequency as combined with the mass of motor drive 18 is substantially different from that of the resonant vibration system including pile 14, this to avoid any interaction between these two systems. In this manner, the drive system for oscillator 11 is independently vibrationally isolated from the oscillator so that, in effect, the drive system is vibrationally isolated from the output of the oscillator. Moreover, since the mass of motor 18 is fixed, there are no wide range excursions required of springs 42 and 43, such as spring 32 experiences with various weight piles.

Figure 2:
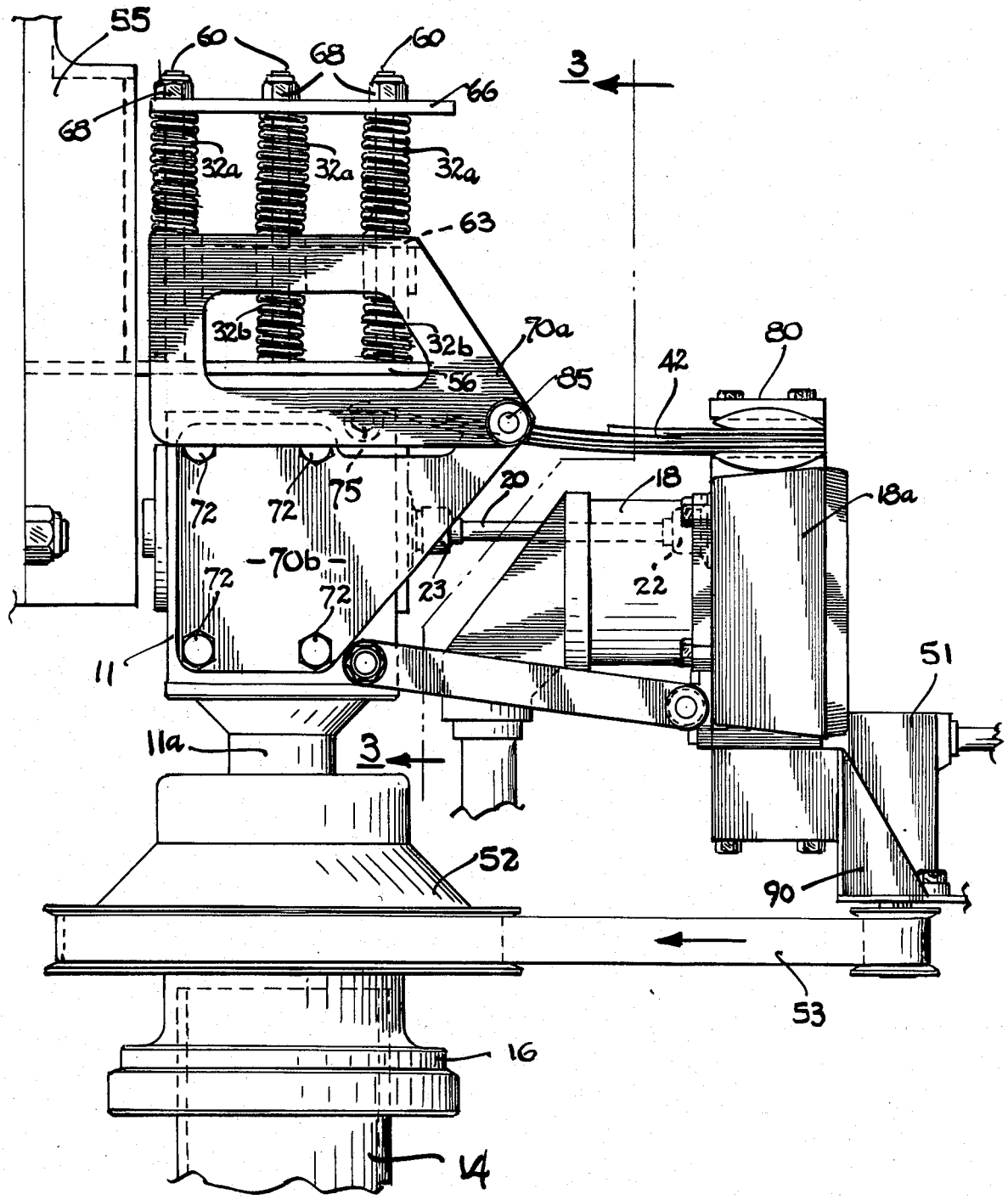
FIG. 2 is a side elevational view of a second embodiment of the invention.
Figure 3:
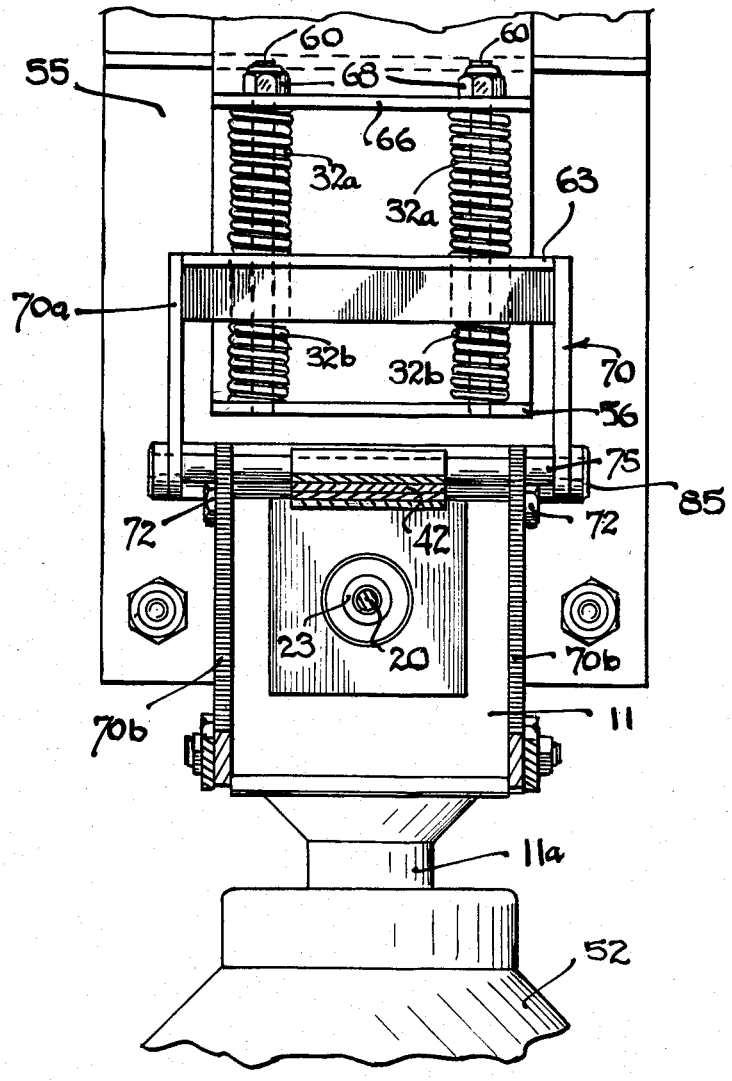
FIG. 3 is a view taken along the plane indicated by 3—3 in FIG. 2.

Referring now to FIGS. 2 and 3, a second embodiment of the invention is illustrated. A support frame 55, only a portion of which is shown, is suspended from a crane as for the previous embodiment. Support plate 56 is fixedly attached to support frame 55, as for example by welding. Bolts 60 have their lower ends fixedly attached to plate 56 as for example by welding. Each of these bolts has a lower spring **32*b* slidably mounted thereover, these springs abutting against plate 56. Plate 63, which is appropriately apertured so that each of bolts 60 can be fitted therethrough is slideably supported on bolts 60 and abuts against the top ends of springs 32*b*. Upper springs 32*a* are mounted over the upper portions of bolts 60 with the bottom ends of each such spring abutting against the top surface of plate 63. A top plate 66 is suitably apertured so that the top ends of bolts 60 will fit therethrough. Springs 32*a* and 32*b* are retained in compression between plates 66, 63 and 56 by means of nuts 68 which threadably engage the ends of bolts 60 and are tightened down against plate 66 to place the desired compressive load on the springs with plate 63 sandwiched between the upper springs 32*a* and the lower springs 32*b*. Such precompression of the springs with the sandwiched construction with plate 63 enables the handling of either upwardly or downwardly biased loads from frame 55. Plate 63 is attached to the casing of oscillator 11 by means of upper and lower opposing pairs of brackets 70*a* and 70*b*, brackets 70*b* being bolted to the oscillator casing by means of bolts 72. Brackets 70*a* and 70*b* are pivotally attached to trunnion 85 and thus the lower brackets 70*b* have limited freedom of rotatable motion. Upper brackets 70*a* are fixedly attached to plate 63**, as for example, by welding.

The multiple elongated springs **32*a* and 32*b* afford a relatively low spring rate for effectively isolating the vibrational energy generated by the oscillator from support frame 55. At the same time, these springs can deform elastically to provide the high capacity for handling the high loads involved in lifting and lowering the pile member 14. It is to be noted that when the support frame 48 is lifted, plate 56 moves upwardly towards plate 63 compressing the springs 32*b*** considerably.

As for the previous embodiment, oscillator 11 is rotatably driven by means of hydraulic motor 18 through the gear train in gear box, **18*a*, drive shaft 20, and universal joints 22 and 23. Vibrational isolation is provided between the oscillator and the power drive by means of leaf spring 42. The leaf spring is attached at one end thereof to lower brackets 70*b* by means of a free turning link bolt 75. Brackets 70*b*, as already noted, are fixedly attached to the oscillator housing. The other end of leaf spring 42 is clamped to fixed mass gear box 18*a* by means of adjustable spherical clamp 80 which can be adjusted to provide a permanently level attitude on the average for drive shaft 20. Thus, as for the previous embodiment, one end of spring 42 is free to vibrate along with the oscillator housing while the end of the spring attached to gear box 18*a* provides a resilient suspension which closely maintains the general alignment of shaft 20 with the oscillator. This avoids stress on the shaft and its associated components, this suspension system being significantly independent of that involved with widely stretching springs 32*a* and 32*b*. It is to be further noted that as for the previous embodiment, the spring rate of spring 42 must be chosen so as to not form a resonant vibration system with the mass of the associated components at the frequency of vibration at which pile 14** is being driven by the oscillator or the natural resonant frequency of the pile. This spring rate is preferably chosen to provide natural resonance with its associated components at a frequency substantially lower than the natural resonant frequency of the pile.

Pile member 14 is coupled to the oscillator by means of clamp member 16 through a rotary swivel mechanism 52 which is rotatably coupled to a cylindrical extension **11*a* which extends from the oscillator housing. Swivel 52 incorporates a roller bearing therein, and can be rotatably driven by means of drive belt 53 which is coupled to the output shaft of hydraulic motor 51. Hydraulic motor 51 is supported on gear box 18*a* by means of bracket 90. Thus, the pile 14 may be optionally driven rotatably as it is being sonically driven to facilitate the driving action. The long stroke isolation of springs 32*a* and 32*b* provide close control of down force on the piling so that swivel 52** can be rotated with relatively small torque.

While the invention has been described and illustrated in detail, it is to be clearly understood that this is intended by way of illustration example only and is not to be taken by way of limitation, the spirit and scope of the invention being limited only by the terms of the following claims.

I claim:

1. In a sonic pile driving system for driving a pile into an earthen formation, said system having support and suspension means for suspending and supporting the pile while it is being driven, a sonic oscillator for generating sonic energy; means for coupling the energy from the oscillator to the pile and means for driving said oscillator to generate sonic energy at a predetermined frequency, the improvement being separate systems for vibrationally isolating the support and suspension means from the sonic energy and the oscillator drive means from the sonic energy, said improvement comprising;

first spring means having the capability of a relatively large range of elastic deformation interposed between the support and suspension means and the oscillator for vibrationally isolating the support and suspension means from the oscillator said first spring means being capable of handling a large range of high loads; and second spring means having a relatively low load capacity and small elastic deformation capability as compared with said first spring means interposed between the oscillator and the oscillator drive means for providing a limited range of relative motion and vibrational isolation between said oscillator drive means and the oscillator, the resonant frequency of the vibration system formed by said second spring means and the oscillator drive means suspended thereon being substantially different from the frequency of the sonic energy driving the pile.

2. The pile driving system of claim 1 wherein the resonant frequency of the vibration system formed by said second spring means and oscillator the drive means is substantially lower than the natural resonant frequency of the pile.

3. The system of claim 1 wherein said second spring means includes a plurality of paired upper and lower coil springs and further including a center plate sandwiched between the upper and lower springs, means for attaching said center plate to the sonic oscillator, and a lower plate attaching to said support and suspension means, the bottom ends of said lower springs abutting against said lower plate.

4. The system of claim 1 wherein said first spring means has relatively long elastic deformation within the range of loads placed thereon so as to aid the isolation.

5. The system of claim 1 wherein said second spring means operates within a relatively short elastic deformation range in combination with the mass of said oscillator drive means.

6. The system of claim 5 and further including adjustable mounting means for said second spring means so as to adjust the relative location of said oscillator and its drive means.

7. The system of claim 1 wherein the second spring means is a leaf spring, one end of said leaf spring being attached to the oscillator, the other end of said leaf spring being attached to the oscillator drive means.

8. The system of claim 1 and further including means for rotatably driving the pile.

9. The system of claim 8 wherein said means for rotatably driving the pile comprises a swivel device rotatably coupled to the oscillator and means for fixedly attaching the pile to the swivel device.

* * * * *